US009116462B2

(12) United States Patent
Ota

(10) Patent No.: US 9,116,462 B2
(45) Date of Patent: Aug. 25, 2015

(54) IMAGE FORMING APPARATUS

(71) Applicant: FUJI XEROX CO., LTD., Tokyo (JP)

(72) Inventor: Naoki Ota, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/287,951

(22) Filed: May 27, 2014

(65) Prior Publication Data

US 2015/0139682 A1 May 21, 2015

(30) Foreign Application Priority Data

Nov. 15, 2013 (JP) ..... 2013-237273

(51) Int. Cl.
*G03G 15/08* (2006.01)

(52) U.S. Cl.
CPC ..... *G03G 15/0812* (2013.01)

(58) Field of Classification Search
CPC ..... G03G 2221/0057; G03G 21/0058; G03G 21/0011; G03G 21/0076; G03G 21/007
See application file for complete search history.

(56) References Cited

U.S. PATENT DOCUMENTS

| | | | | |
|---|---|---|---|---|
| 5,328,795 | A * | 7/1994 | Yamashiro et al. | 430/137.19 |
| 2006/0093955 | A1* | 5/2006 | Ohshima et al. | 430/125 |
| 2007/0020005 | A1* | 1/2007 | Shigezaki et al. | 399/349 |
| 2009/0041519 | A1* | 2/2009 | Uchida et al. | 399/350 |
| 2009/0092918 | A1 | 4/2009 | Moffat | |
| 2012/0281997 | A1* | 11/2012 | Nakazawa et al. | 399/111 |

FOREIGN PATENT DOCUMENTS

| | | |
|---|---|---|
| JP | A-2009-093178 | 4/2009 |
| JP | A-2013-156343 | 8/2013 |

* cited by examiner

*Primary Examiner* — David Gray
*Assistant Examiner* — Sevan A Aydin
(74) *Attorney, Agent, or Firm* — Oliff PLC

(57) ABSTRACT

An image forming apparatus includes an image holding member, a charging unit, an electrostatic charge image forming unit, a developing unit that accommodates an electrostatic charge image developer containing flake shape toner particles, a transfer unit, an arranging unit that causes transfer residual toner to rise from the surface of the image holding member, a cleaning unit, and a fixing unit.

14 Claims, 2 Drawing Sheets

IMAGE FORMING APPARATUS

CROSS-REFERENCE TO RELATED APPLICATIONS

This application is based on and claims priority under 35 USC 119 from Japanese Patent Application No. 2013-237273 filed Nov. 15, 2013.

BACKGROUND

1. Technical Field

The present invention relates to an image forming apparatus.

2. Related Art

In an office or at home, a demand for reproducing a metallic color of a subject with a copying machine or a printer has been increased.

SUMMARY

According to an aspect of the invention, there is provided an image forming apparatus including:

an image holding member;

a charging unit that charges a surface of the image holding member;

an electrostatic charge image forming unit that forms an electrostatic charge image on a charged surface of the image holding member;

a developing unit that accommodates an electrostatic charge image developer containing flake shape toner particles and develops the electrostatic charge image, which is formed on the surface of the image holding member, using the electrostatic charge image developer to form a toner image;

a transfer unit that transfers the toner image, which is formed on the surface of the image holding member, onto a surface of a recording medium;

an arranging unit that causes transfer residual toner, which remains on the surface of the image holding member, to rise from the surface of the image holding member;

a cleaning unit that includes a cleaning blade for cleaning the transfer residual toner remaining on the surface of the image holding member; and a fixing unit that fixes the toner image which is transferred onto the surface of the recording medium.

BRIEF DESCRIPTION OF THE DRAWINGS

Exemplary embodiments of the present invention will be described in detail based on the following figures, wherein.

DETAILED DESCRIPTION

Figure 1:
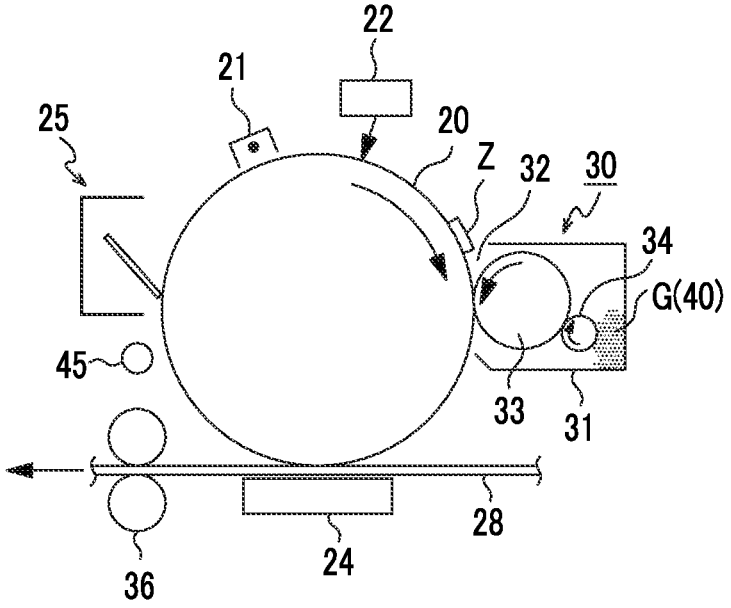
FIG. 1 is a diagram schematically illustrating a configuration of an image forming apparatus according to a first exemplary embodiment of the invention.

Hereinafter, exemplary embodiments of an image forming apparatus according to the invention will be described in detail.

First Exemplary Embodiment

An image forming apparatus according to a first exemplary embodiment includes: an image holding member; a charging unit that charges a surface of the image holding member; an electrostatic charge image forming unit that forms an electrostatic charge image on a charged surface of the image holding member; a developing unit that accommodates an electrostatic charge image developer containing flake shape toner particles and develops the electrostatic charge image, which is formed on the surface of the image holding member, using the electrostatic charge image developer to form a toner image; a transfer unit that transfers the toner image, which is formed on the surface of the image holding member, onto a surface of a recording medium; an arranging unit that causes transfer residual toner, which remains on the surface of the image holding member, to rise from the surface of the image holding member; a cleaning unit that includes a cleaning blade for cleaning the transfer residual toner remaining on the surface of the image holding member; and a fixing unit that fixes the toner image which is transferred onto the surface of the recording medium, in which the flake shape toner particles contain tabular shape metal pigments having an average major axis length of from 5 μm to 12 μm and an average thickness of from 0.01 μm to 0.5 μm and have an average major axis length of from 7 μm to 20 μm, an average thickness of from 1 μm to 3 μm, and an average circularity of from 0.5 to 0.9.

A toner including a tabular shape metal pigment is likely to be flake shape according to the shape of the metal pigment. Due to a combined force of an electrostatic adhesive force and a surface frictional force, the flake shape toner is likely to be attached on a surface of an image holding member such that a surface thereof intersecting a thickness direction is substantially parallel to the surface of the image holding member. When the flake shape toner in the parallel state enters a cleaning unit including a cleaning blade, the flake shape toner enters a contact portion between the image holding member and the cleaning blade without being scraped by the cleaning blade and is likely to enter the portion between the cleaning blade and the image holding member. Therefore, cleaning failure occurs. For example, the entered toner may be passed through; or the blade is pulled up due to the entered toner such that toner particles having a smaller size may be passed through.

In the image forming apparatus according to the exemplary embodiment, cleaning failure which may occur during the use of flake shape toner is not likely to occur. The reason is not clear but is presumed to be as follows.

The image forming apparatus according to the exemplary embodiment includes the arranging unit that causes transfer residual toner, which remains on the surface of the image holding member, to rise from the surface of the image holding member. By the arranging unit causing the transfer residual toner to rise from the surface of the image holding member, it is difficult for the flake shape toner to enter a nip portion between the cleaning blade and the image holding member, and the transfer residual toner is likely to be scraped by the cleaning blade. As a result, cleaning failure is not likely to occur.

In the exemplary embodiment, "causing the toner to rise from the surface of the image holding member" refer to causing a surface of the flake shape toner intersecting a thickness direction to rise from the surface of the image holding member.

Hereinafter, the image forming apparatus according to the first exemplary embodiment will be described with reference to the drawing. Major components illustrated in the drawing will be described, and the other components will not be described.

FIG. 1 is a diagram schematically illustrating a configuration of the image forming apparatus according to the first exemplary embodiment.

In FIG. 1, the image forming apparatus according to the first exemplary embodiment includes a photoreceptor drum 20 as the image holding member that rotates in a predetermined direction. Around the photoreceptor drum 20, a charging unit 21 as the charging unit that charges the photoreceptor drum 20; an exposure unit 22 as the electrostatic charge image forming unit that forms an electrostatic charge image Z on the photoreceptor drum 20; a developing unit 30 as the developing unit that develops the electrostatic charge image Z, which is formed on the photoreceptor drum 20, to be visualized as a toner image; a transfer unit 24 as the transfer unit that transfers the toner image, which is visualized on the photoreceptor drum 20, onto a recording sheet 28 which is a recording medium; a voltage applying unit 45 as the arranging unit that applies an electric field between the voltage applying unit 45 and the photoreceptor drum 20; and a cleaning unit 25 as the cleaning unit that includes a cleaning blade for cleaning transfer residual toner remaining on the photoreceptor drum 20 are sequentially arranged.

In the exemplary embodiment, as illustrated in FIG. 1, the developing unit 30 includes a developer housing 31 that accommodates a developer G containing toner 40. In the developer housing 31, a developing opening 32 is formed opposite to the photoreceptor drum 20. A developing roller (developing electrode) 33 is provided as a toner holding member next to the developing opening 32. By applying a predetermined developing bias to the developing roller 33, a development field is formed in a region (development region) interposed between the photoreceptor drum 20 and the developing roller 33. Further, in the developer housing 31, a developer supply roller 34 is provided opposite to the developing roller 33.

As the charging unit 21, for example, a contact type charging member using a conductive or semi-conductive charging roller, a charging brush, a charging film, a charging rubber blade, or a charging tube may be used. In addition, a non-contact type charging roller or a well-known charger using corona discharge such as a scorotron charger or a corotron charger may also be used.

Examples of the exposure unit 22 include optical units that expose the surface of the photoreceptor drum 20 to light such as semiconductor laser light, LED light, or liquid crystal shutter light according to an image data. A wavelength of a light source is in a spectral sensitivity range of the photoreceptor drum. As a wavelength of a semiconductor laser, near infrared light having an oscillation wavelength of about 780 nm is commonly used. However, the wavelength of the semiconductor laser is not limited to this wavelength. A laser having an oscillation wavelength of about 600 nm or a blue laser having an oscillation wavelength of from 400 nm to 450 nm may also be used. In addition, in order to form a color image, a surface emission type laser light source capable of outputting multi beams may also be effectively used.

As the cleaning unit 25, a unit including a cleaning blade may be used.

A material of the cleaning blade is not particularly limited, and various elastic members may be used. Specific examples of the elastic members include a polyurethane elastic member, silicone rubber, and chloroprene rubber.

As the polyurethane elastic member, polyurethane which is synthesized through an addition reaction of isocyanate, polyol, and various hydrogen-containing compounds is commonly used. In order to prepare this polyurethane elastic member, a methane prepolymer is prepared using a polyol component and an isocyanate component, a curing agent is added thereto, and the obtained, mixture is put into a mold, followed by crosslinking, curing, and aging at room temperature. In this case, examples of the polyol component include polyether-based polyols such as polypropylene glycol or polytetramethylene glycol; and polyester-based polyols such as adipate-based polyols, polycaprolactam-based polyols, or polycarbonate-based polyols. Examples of the isocyanate component include aromatic polyisocyanates such as tolylene diisocyanate, 4,4'-diphenylmethane diisocyanate, polymethylene polyphenyl polyisocyanate, or toluidine diisocyanate; and aliphatic polyisocyanates such as hexamethylene diisocyanate, isophorone diisocyanate, xylylene diisocyanate, or dicyclohexylmethane diisocyanate. As the curing agent, typically, dihydric alcohols such as 1,4-butandiol and tri- or higher-hydric alcohols such as trimethylolpropane or pentaerythritol may be used in combination.

When a rubber hardness (according to Durometer type A of JIS K 6253-3:2012) of the cleaning blade is 50° or greater, the cleaning blade is not likely to be worn. Therefore, toner passing through is not likely to occur. When the rubber hardness is 100° or less, the cleaning blade is not so hard. Therefore, the image holding member is not likely to be worn, and deterioration in cleaning performance is suppressed.

In addition, when a 300% modulus indicating a tensile stress at an elongation of a sample of 300% is $784.5\times10^4$ Pa (80 kgf/cm$^2$) or greater, a blade edge is not likely to be deformed or torn. Therefore, the cleaning blade has a strong resistance to cracking and wear, and thus toner passing through is not likely to occur. On the other hand, when the 300% modulus is $5393.7\times10^4$ Pa (550 kgf/cm$^2$) or less, the followability of the cleaning blade on the surface shape of the image holding member is prevented from deteriorating due to the deformation of the cleaning blade. Therefore, cleaning failure caused by contact failure is suppressed.

Further, in the cleaning blade in which the rebound resilience defined in the test method of rebound resilience according to JIS K 6255:1996 (hereinafter simply referred to as "rebound resilience") is 4% or greater, the reciprocation of a blade edge for scraping toner is likely to occur, and thus toner passing through is not likely to occur. In addition, in the cleaning blade in which the rebound resilience is 85% or less, squeal made from the blade and the curling of the blade are suppressed.

In addition, the deformation amount of the cleaning blade (amount of the cleaning blade deformed by being pressed against the surface of the image holding member) varies depending on the situation, but is preferably from 0.8 mm to 1.6 mm and more preferably from 1.0 mm to 1.4 mm. Further, the contact angle of the cleaning blade with the image holding member (angle formed between the tangent line of the surface of the image holding member and the cleaning blade) varies depending on the situation, but is preferably from about 18° to about 28°.

Examples of the transfer unit 24 include a contact type transfer charger using a belt, a roller, a film, or a rubber blade; and a well-known transfer charger using corona discharge such as a scorotron transfer charger or a corotron transfer charger.

Examples of the voltage applying unit 45 include a conductive pole plate that causes an electric field to be generated with a well-known scorotron or a corotron transfer charger or the surface of the photoreceptor. A potential applied by the voltage applying unit 45 may be a DC component, an AC component, or a component in which an AC component is superimposed on a DC component. For example, when a DC applied voltage Vdc is from −300 V to −700 V, an AC voltage peak width Vp-p may be in a range of from 0.5 kv to 2.0 kV. The DC applied voltage is preferably from ±200 V to ±700 V, and more preferably from ±200 V to ±500 V. Further, the electric field E (V/m) is expressed as (the applied voltage (V) by the charging unit)/(the distance (m) between the charged body and the charging unit).

In FIG. 1, the voltage applying unit is used as the arranging unit. However, in the exemplary embodiment, a gas ejection unit that ejects high-pressure gas such as compressed air to the surface of the photoreceptor drum 20 may be used as the arranging unit instead of the voltage applying unit such that the transfer residual toner remaining on the surface of the photoreceptor drum 20 is caused to rise from the surface of the photoreceptor drum 20.

Next, the operation of the image forming apparatus according to the first exemplary embodiment will be described.

When an image forming process starts, first, the surface of the photoreceptor drum 20 is charged by the charging unit 21, the exposure unit 22 forms the electrostatic charge image Z on the charged photoreceptor drum 20, and the developing unit 30 develops the electrostatic chare image Z to be visualized as the toner image. Next, the toner image formed on the photoreceptor drum 20 is transported onto a transfer portion, and the transfer unit 24 electrostatically transfers the toner image, which is formed on the photoreceptor drum 20, onto the recording sheet 28 which is a recording medium. Toner remaining on the photoreceptor drum 20 is caused to rise from the surface of the photoreceptor drum 20 by the voltage applying unit 45 and then is cleaned by the cleaning unit 25. Next, the toner image on the recording sheet 28 is fixed by the fixing unit 36, and an image is formed thereon.

The toner according to the exemplary embodiment which is applied to the image forming apparatus according to the first exemplary embodiment is flake shape toner (hereinafter also referred to as "specific toner") that includes tabular shape metal pigments (hereinafter also referred to as "specific metal pigment") having an average major axis length of from 5 μm to 12 μm and an average thickness of from 0.01 μm to 0.5 μm and has an average major axis length of from 7 μm to 20 μm, an average thickness of from 1 μm to 3 μm, and an average circularity of from 0.5 to 0.9.

Since the specific toner includes the specific metal pigment, brilliance is exhibited. "Brilliance" described in this exemplary embodiment refers to brilliance similar to metallic luster when an image formed using the specific toner is observed.

In a case where a solid image is formed using the specific toner, when light is incident on the image by a variable angle photometer at an incident angle of −45°, a ratio (A/B) of a reflectance A at an acceptance angle of +30° to a reflectance B at an acceptance angle of −30° is preferably from 2 to 100.

The ratio (A/B) being 2 or higher implies that the reflection amount to a side (+ angle side) opposite to an incident side where the light is incident is greater than that to the incident side (− angle side), that is, implies that the diffuse reflection of the incident light is suppressed. When the diffuse reflection in which the incident angle is reflected in various directions occurs, the color of the reflected light visually appears to be dull. Therefore, when the ratio (A/B) is lower than 2, luster may not be visually recognized in the reflection light, and brilliance may deteriorate.

On the other hand, when the ratio (A/B) is higher than 100, a view angle at which the reflection light is visually recognized is excessively narrowed, and the amount of specular reflection light components is large. Accordingly, the reflection light may appear to be black depending on the viewing angle. In addition, it is difficult to prepare a toner having a ratio (A/B) of higher 100.

The ratio (A/B) is preferably from 50 to 100, more preferably from 60 to 90, and still more preferably from 70 to 80.

Measurement of Ratio (A/R) Using Variable Angle Photometer

First, the incident angle and the acceptance angle will be described. During the measurement in the exemplary embodiment using the variable angle photometer, the incident angle is set to −45° because the measurement sensitivity to an image having a wide range of brilliance degree is high.

In addition, the reason for setting the acceptance angle to −30° and +30° is that the measurement sensitivity is highest for evaluating an image having brilliance and an image having no brilliance.

Next, a method of measuring the ratio (A/B) will be described.

In the exemplary embodiment, first, "solid image" is formed with the following method during the measurement of the ratio (A/B). A developer sample is filled in a developing unit of DocuCentre-III C7600 (manufactured by Fuji Xerox Co., Ltd.), and a solid image is formed on recording sheet (OK TOP COAT+ paper, manufactured by Oji Paper Co., Ltd.) under conditions of a fixing temperature of 190° C., a fixing pressure of 4.0 kg/cm$^2$, and a toner deposition amount of 4.5 g/cm$^2$. "The solid image" described herein refers to an image having a printing rate of 100% .

Using a variable angle spectrophotometer GC5000L (manufactured by Nippon Denshoku Industries Co, Ltd.) as a variable angle photometer, light is incident on an image portion of the formed solid image at an incident angle of −45° with respect to the solid image, and the reflectance A at an acceptance angle of +30° and the reflectance B at an acceptance angle of −30° are measured. The reflectance A and the reflectance B of light having a wavelength range of 400 nm to 700 nm are measured at intervals of 20 nm, and the average of reflectances at the respective wavelengths is obtained. Based on the measurement results, the ratio (A/B) is calculated.

Next, components forming the specific toner will be described.

The specific toner includes toner particles and optionally may further include external additives.

For example, the toner particles include a binder resin and the specific metal pigment and optionally may further include a release agent and other additives.

Metal Pigment

Examples of the specific metal pigment used in the exemplary embodiment include metal powder of aluminum, brass, bronze, nickel, zinc, and the like. In addition, a coated pigment in which a surface of the metal pigment is coated with at least one metal oxide selected from the group consisting of silica, alumina, and titania may be used.

Among these, as the specific metal pigment, a pigment containing aluminum (Al) is preferable from the viewpoints of, for example, being easily available and easily obtaining a tabular shape.

When the pigment containing Al is used as the metal pigment, the Al content in the metal pigment is preferably from 40% by weight to 100% by weight and more preferably from 60% by weight to 98% by weight.

The average major axis length and the average thickness of the specific metal pigments are from 5 μm to 12 μm and from 0.01 μm to 0.5 μm, respectively.

The major axis length of the metal pigment refers to the longest portion of the metal pigment when observed from the thickness direction of the metal pigment.

When the average major axis length of the metal pigments is less than 5 μm, it is difficult for the specific toner to exhibit brilliance. When the average major axis length of the metal pigments is greater than 12 μm, it is difficult to prepare the toner. The average major axis length of the specific metal pigments is preferably from 5 μm to 12 μm and more preferably from 5 μm to 9 μm.

In addition, when the average thickness of the metal pigments is less than 0.01 μm, a problem of deterioration in brilliance may occur due to the deformation and shrinkage of the metal pigment. When the average thickness of the metal pigments is greater than 0.5 μm, it is difficult for the specific toner to exhibit brilliance. The average thickness of the specific metal pigments is preferably from 0.01 μm to 0.5 μm and more preferably from 0.01 μm to 0.3 μm.

The content of the metal pigment in the specific toner is preferably from 1 part by weight to 70 parts by weight and more preferably from 5 parts by weight to 50 parts by weight with respect to 100 parts by weight of the binder resin described below. In the exemplary embodiment, the average major axis length and the average thickness of the metal pigments refer to values measured with the following method.

50 pigment particles are imaged using a scanning electron microscope (SEM) to obtain enlarged images, major axis lengths and thicknesses thereof are measured from the enlarged images, and the average values thereof are calculated.

Binder Resin

Examples of the binder resin include vinyl-based resins including homopolymers of one monomer and copolymers two or more monomers selected from the following monomers: styrenes (for example, styrene, para-chlorostyrene, or α-methylstyrene); (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate); ethylenically unsaturated nitriles (for example, acrylonitrile or methacrylonitrile); vinyl ethers (for example, vinyl methyl ether or vinyl isobutyl ether); vinyl ketones (for example, vinyl methyl ketone, vinyl ethyl ketone, or vinyl isopropenyl ketone); and olefins (for example, ethylene, propylene or butadiene).

Other examples of the binder resin include non-vinyl-based resins such as epoxy resins, polyester resins, polyurethane resins, polyamide resins, cellulose resins, polyether resins, or modified rosins; mixtures of the non-vinyl-based resins with the vinyl-based resins; and graft polymers obtained by polymerization of vinyl-based monomers in the coexistence of the above-described resins.

These binder resins may be used alone or in a combination of two or more kinds.

As the binder resin, a polyester resin is preferable.

Examples of the polyester resin include well-known polyester resins.

Examples of the polyester resin include a polycondensate of a polyvalent carboxylic acid and a polyol. As an amorphous polyester resin, a commercially available resin may be used, or a synthesized resin may be used.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenylsuccinic acid, adipic acid, or sebacic acid); alicyclic dicarboxylic acids (for example, cyclohexane dicarboxylic acid); aromatic dicarboxylic acids (for example, terephthalic acid, isophthalic acid, phthalic acid, or naphthalene dicarboxylic acid); anhydrides of the above-described acids; and lower (for example, the number of carbon atoms is from 1 to 5) alkyl esters of the above-described acids. Among these, as the polyvalent carboxylic acid, aromatic dicarboxylic acids are preferable.

As the polyvalent carboxylic acid, a tri- or higher-valent carboxylic acid having a crosslinked structure or a branched structure may be used in combination of a dicarboxylic acid. Examples of the tri- or higher-valent carboxylic acid include trimellitic acid, pyromellitic acid, anhydrides thereof, and lower (for example, the number of carbon atoms is from 1 to 5) alkyl esters thereof.

These polyvalent carboxylic acids may be used alone or in a combination of two or more kinds.

Examples of the polyol include aliphatic diols (for example, ethylene glycol, diethylene glycol, triethylene glycol, propylene glycol, butane diol, hexane diol, or neopentyl glycol); alicyclic diols (for example, cyclohexane diol, cyclohexane dimethanol, or hydrogenated bisphenol A); and aromatic diols (for example, ethylene oxide adducts of bisphenol A or propylene oxide adducts of bisphenol A). Among these, as the polyol, for example, aromatic diols and alicyclic diols are preferable, and aromatic diols are more preferable.

As the polyol, a tri- or higher-hydric alcohol having a crosslinked structure or a branched structure may be used in combination of a diol, Examples of the tri- or higher-hydric alcohol include glycerin, trimethylolpropane, and pentaerythritol.

These polyols may be used alone or in a combination of two or more kinds.

A glass transition temperature (Tg) of the polyester resin is preferably from 50° C. to 80° C. and more preferably from 50° C. to 65° C.

The glass transition temperature may be obtained from a DSC curve obtained by differential scanning calorimetry (DSC), more specifically, may be obtained by "extrapolation glass transition start temperature" described in a method of obtaining a glass transition temperature according to JIS K7121-1987 "method of measuring transition temperature of plastics".

A weight average molecular weight (Mw) of the polyester resin is preferably from 5,000 to 1,000,000 and more preferably from 7,000 to 500,000.

A number average molecular weight (Mn) of the polyester resin is preferably from 2,000 to 100,000.

A molecular weight distribution Mw/Mn of the polyester resin is preferably 1.5 to 100 and more preferably from 2 to 60.

The weight average molecular weight and the number average molecular weight are measured by gel permeation chromatography (GPC). The molecular weight measurement by GPC is performed in a THF solvent by using HLC-8120 (GPC manufactured by Tosoh Corporation) as a measuring device and using TSKgel SuperHM-M (15 cm) (a column manufactured by Tosoh Corporation). The weight average molecular weight and the number average molecular weight are calculated using a molecular weight calibration curve that is prepared from a monodisperse polystyrene standard sample based on the measurement result.

The polyester resin may be prepared using, for example, a well-known preparation method. Specifically, in this method, for example, a polymerization temperature is set to be from. 180° C. to 230° C., the internal pressure of the reaction system is optionally decreased, and a reaction is caused while removing water and alcohol produced during condensation.

When monomers of raw materials are not soluble or compatible at a reaction temperature, a high boiling point solvent may be added thereto as a solubilizer to dissolve the monomers therein. In this case, the polycondensation reaction is carried out while distilling the solubilizer away. When a monomer having poor compatibility is present in the copolymerization reaction, the monomer having poor compatibility may be condensed with an acid or an alcohol which is to be poly condensed with the monomer, and then the obtained condensate may be polycondensed with a major component.

The content of the binder resin is, for example, preferably from 40% by weight to 95% by weight, more preferably from 50% by weight to 90% by weight, and still more preferably from 60% by weight to 85% by weight with respect to the total weight of the toner particles.

Release Agent

Examples of the release agent include hydrocarbon waxes; natural waxes such as carnauba wax, rice wax, or candelilla wax; synthetic or mineral and petroleum waxes such as montan wax; and ester waxes such as fatty acid esters or montanic acid esters. The release agent is not limited to these examples.

A melting point of the release agent is preferably from 50° C. to 110° C. and more preferably from 60° C. to 100° C.

The melting point may be obtained from a DSC curve obtained by differential scanning calorimetry (DSC) using "melting peak temperature" described in a method of obtaining a melting point according to JIS K7121:1987 "method of measuring transition temperature of plastics".

The content of the release agent is, for example, preferably from 1% by weight to 20% by weight and more preferably from 5% by weight to 15% by weight with respect to the total weight of the toner particles.

Other Additives

Examples of other additives include well-known additives such as a magnetic material, a charge-controlling agent, or an inorganic powder. The toner particles contain these additives as internal additives.

The average major axis length and the average thickness of the specific toner are from 7 μm to 20 μm and from 1 μm to 3 μm, respectively.

The major axis length of the toner refers to the longest portion of the toner when observed from the thickness direction of the toner.

When the average major axis length of the toner is less than 7 μm, a problem of deterioration in brilliance may occur. When the average major axis length of the toner is greater than 20 μm, a problem of image defect or deterioration in image graininess may occur. The average major axis length of the specific toner is preferably from 7 μm to 20 μm and more preferably from 8 μm to 15 μm.

In addition, when the average thickness of the toner is less than 1 μm, a problem of deterioration in the fluidity of the toner may occur. When the average thickness of the toner is greater than 3 μm, a problem of deterioration in brilliance may occur due to arrangement variation. The average thickness of the specific toner is preferably from 1 μm to 3 μm. In the exemplary embodiment, the average major axis length and the average thickness of the toner refer to values measured with the following method.

100 toner particles are imaged using a scanning electron microscope (SEM) to obtain enlarged images, major axis lengths and thicknesses thereof are measured from the enlarged images, and the average values thereof are calculated.

The average circularity of the specific toner is from 0.5 to 0.9. When the average circularity of the toner is less than 0.5, a problem of image defect or deterioration in image graininess may occur. When the average circularity of the toner is greater than 0.9, a problem of cleaning failure may occur due to a toner rolling property. The average circularity of the specific toner is preferably from 0.5 to 0.9 and more preferably from 0.5 to 0.8.

In the exemplary embodiment, the average circularity of the toner is measured using FPIA-300 (manufactured by Sysmex Corporation) as a flow particle image analyzer. As a specific measurement method, from 0.1 ml to 0.5 ml of a surfactant, (alkylbenzene sulfonate) as a dispersant is added to from 100 ml to 150 ml of water in which solid impurities are removed in advance, and from 0.1 g to 0.5 g of a measurement sample is further added thereto. A suspension in which the measurement sample is added is dispersed with a ultrasonic disperser for 1 minute to 3 minutes such that the concentration of the dispersion is from 3000 particles/μl to 10000 particles/μl. Then, the circularity of the toner is measured using the above-described analyzer. The circularity is calculated from the following expression:

$$\text{Circularity}=\text{Peripheral Length of Equivalent Circle Diameter/Peripheral Length}=[2\times(A\pi)^{1/2}]/PM$$

(wherein A represents a projected area, and PM represents a peripheral length).

The circularity is obtained from the above expression, and the average value thereof is obtained as the average circularity.

The volume average particle size of the specific toner is preferably from 1 μm to 30 μm and more preferably from 3 μm to 20 μm.

The volume average particle size $D_{50v}$ is obtained as follows. A volume cumulative distribution and a number cumulative distribution are drawn from the smallest particle size side in particle size ranges (channels) divided based on a particle size distribution which is measured with a measurement instrument such as MULTISIZER II (manufactured by Beckman Coulter Inc.). Particle sizes having a cumulative value of 16% are defined as a volume average particle size $D_{16v}$ and a number average particle size $D_{16p}$, respectively. Particle sizes having a cumulative value of 50% are defined. as a volume average particle size $D_{50v}$ and a number average particle size $D_{50p}$, respectively. Particle sizes having a cumulative value of 84% are defined as a volume average particle size $D_{84v}$ and a number average particle size $D_{84p}$, respectively. Using these values, a volume average particle diameter distribution index (GSDv) is calculated from $(D_{84v}/D_{16v})^{1/2}$.

The specific toner may be produced by preparing toner particles and adding external additives to the toner particles.

A method of preparing the toner particles is not particularly limited, and may be prepared using a well-known dry method such as a kneading and pulverizing method or a well-known wet method such as an emulsion aggregating method or a dissolution suspension method.

Electrostatic Charge Image Developer

The electrostatic charge image developer according to the exemplary embodiment includes at least the specific toner.

The electrostatic charge image developer according to the exemplary embodiment may be a single-component developer containing only the specific toner or a two-component developer containing a mixture of the specific toner and a carrier.

The carrier is not particularly limited, and a well-known carrier may be used. Examples of the carrier include a coated carrier in which a core surface formed of magnetic powder is coated with a coating resin; a magnetic powder-dispersed carrier in which magnetic powder is dispersed in a matrix resin; and a resin-impregnated carrier in which porous magnetic powder is impregnated with resin.

The magnetic powder-dispersed carrier and the resin-impregnated carrier may be carriers including: constituent particles of the carrier as a core; and a coating resin for coating the constituent particles of the carrier.

Examples of the magnetic powder include magnetic metals such as iron oxide, nickel, or cobalt; and magnetic oxides such as ferrite or magnetite.

Examples of the conductive particles include particles of metals such as gold, silver, or copper; and particles of carbon black, titanium oxide, zinc oxide, tin oxide, barium sulfate, aluminum borate, potassium titanate, or the like.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, polymethylmethacrylate, a vinyl chloride-vinyl acetate copolymer, a styrene-acrylic acid copolymer, a straight silicone resin containing an organosiloxane bond or modified products thereof, a fluororesin, polyester, polycarbonate, a phenol resin, and an epoxy resin.

The coating resin and the matrix resin may contain other additives such as a conductive material.

Examples of a method of coating the core surface with the coating resin include a coating method using a coating layer-forming solution in which the coating resin and optionally various additives are dissolved or dispersed in an appropriate solvent. The solvent is not particularly limited and may be selected in consideration of the coating resin used, the coating aptitude, and the like.

Specific examples of the resin coating method include a clipping method of clipping the core in the coating layer-forming solution; a spray method of spraying the coating layer-forming solution on the core surface; a fluid bed method of spraying the coating layer-forming solution on the core surface while making the core float with flowing air; and a kneader coater method of mixing the core of the carrier with the coating layer-forming solution in a kneader coater and removing a solvent.

In the two-component developer, a mixing ratio (weight ratio; toner:carrier) of the specific toner to the carrier is preferably 1:100 to 30:100 and more preferably from 3:100 to 20:100.

Second Exemplary Embodiment

An image forming apparatus according to a second exemplary embodiment of the invention includes: an image holding member; a charging unit that charges a surface of the image holding member; an electrostatic charge image forming unit that forms an electrostatic charge image on a charged surface of the image holding member; a developing unit that accommodates an electrostatic charge image developer containing flake shape toner particles and develops the electrostatic charge image, which is formed on the surface of the image holding member, using the electrostatic charge image developer to form a toner image; an intermediate transfer member onto which the toner image, which is formed on the surface of the image holding member, is primarily transferred; a primary transfer unit that primarily transfers the toner image, which is formed on the surface of the image holding member, onto a surface of the intermediate transfer member; a secondary transfer unit that secondarily transfers the toner image, which is primarily transferred onto the surface of the intermediate transfer member, onto a surface of a recording medium; an arranging unit that causes transfer residual toner, which remains on the surface of the intermediate transfer member, to rise from the surface of the intermediate transfer member; a cleaning unit that includes a cleaning blade for cleaning the transfer residual toner remaining on the surface of the intermediate transfer member; and a fixing unit that fixes the toner image which is transferred onto the surface of the recording medium, in which the flake shape toner contains tabular shape metal pigments having an average major axis length of from 5 μm to 12 μm and an average thickness of from 0.01 μm to 0.5 μm and has an average major axis length of from 7 μm to 20 μm, an average thickness of from 1 μm to 3 μm, and an average circularity of from 0.5 to 0.9.

Hereinafter, the image forming apparatus according to the second exemplary embodiment will be described with reference to the drawing. Major components illustrated in the drawing will be described, and the other components will not be described.

Figure 2:
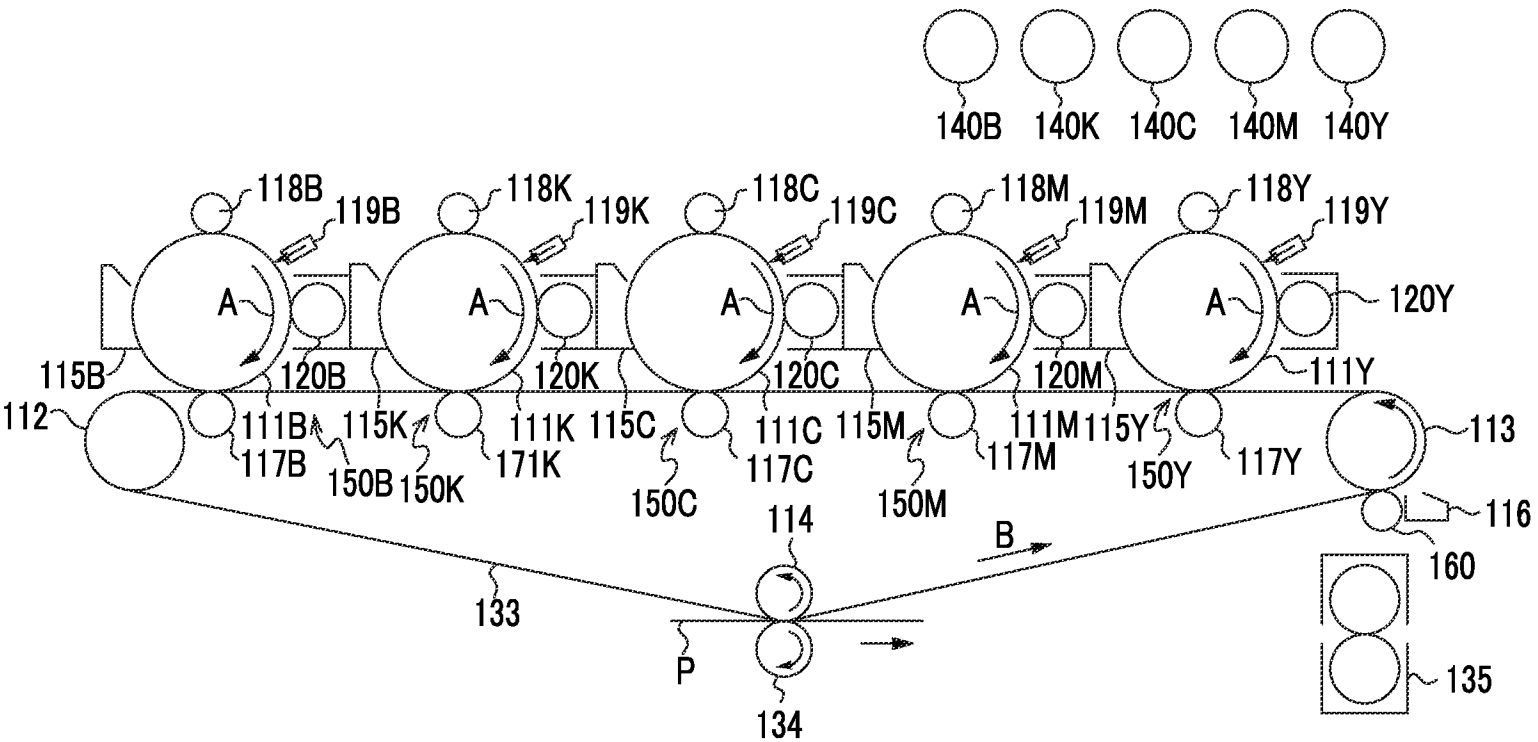
FIG. 2 is a diagram schematically illustrating a configuration of an image forming apparatus according to a second exemplary embodiment of the invention.

FIG. 2 is a diagram schematically illustrating a configuration of the image forming apparatus according to the second exemplary embodiment. The image forming apparatus according to the second exemplary embodiment relates to a tandem-type configuration in which plural photoreceptors, that is, plural image forming units are provided as the image holding member, and is configured as a intermediate transfer type image forming apparatus including an intermediate transfer belt as the intermediate transfer member.

In the image forming apparatus according to the exemplary embodiment, as illustrated in FIG. 2, four image forming units 150Y, 150M, 150C, and 150K that form respective color toner images of yellow, magenta, cyan, and black; and an image forming unit 150B that forms a metallic toner image are arranged in parallel (in tandem) at intervals. The respective image forming units 150B, 150K, 150C, 150M, and 150Y are arranged in this order from a downstream side in a rotating direction of an intermediate transfer belt 133.

Since the respective image forming units 150Y, 150M, 150C, 150K, and 150B have the same configuration except for the color of the toner in the developer accommodated therein, the image forming unit 150Y that forms a yellow image will be described as a representative example. The same components as those of the image forming unit 150Y are represented by reference numerals to which the symbols M (magenta), C (cyan), K (black), and B (metallic) are attached, instead of Y (yellow), and the descriptions of the image forming units 150M, 150C, 150K, and 150B will not be repeated.

The yellow image forming unit 150Y includes a photoreceptor 111Y as the image holding member. This photoreceptor 111Y is rotated and driven at a predetermined process speed by a driving unit (not illustrated) in a direction indicated by arrow A of the drawing. As the photoreceptor 111Y, for example an organic photoreceptor having sensitivity in the infrared range may be used.

A charging roller (charging unit) 118Y is provided over the photoreceptor 111Y. A predetermined voltage is applied to the charging roller 118Y by a power supply (not illustrated) such that a surface of the photoreceptor 111Y is charged to a predetermined potential.

Around the photoreceptor 111Y, an exposure unit (electrostatic image forming unit) 119Y that exposes the surface of the photoreceptor 111Y to light to form an electrostatic charge image is arranged on a downstream side of the charging roller 118Y in the rotating direction of the photoreceptor 111Y. In the exemplary embodiment, due to the space, an LED array capable of reduction in size is used as the exposure unit 119Y, but the exposure unit 119Y is not limited thereto. Other electrostatic charge image forming units using laser beams or the like may also be used.

In addition, around the photoreceptor 111Y, a developing unit 120Y that includes a developer holding member for holding a yellow developer is arranged on a downstream side of the exposure unit 119Y in the rotating direction of the photoreceptor 111Y. The developing unit 120Y forms a toner image on the surface of the photoreceptor 111Y by visualizing the electrostatic charge image, which is formed on the surface of the photoreceptor 111Y, using the yellow toner.

Below the photoreceptor 111Y, the intermediate transfer belt (primary transfer unit) 133 onto which the toner image formed on the surface of the photoreceptor 111Y is primarily transferred is arranged to extend across lower sections of the five photoreceptors 111Y, 111M, 111C, 111K, and 111B. This intermediate transfer belt 133 is pressed against the surface of the photoreceptor 111Y by a primary transfer roller 117Y. In addition, the intermediate transfer belt 133 is stretched by three rollers of a driving roller 112, a supporting roller 113, and a bias roller 114 and is rotated in a direction indicated by arrow B at a moving speed equal to the process speed of the photoreceptor 111Y. The yellow toner image is primarily transferred onto a surface of the intermediate transfer belt 133, and respective color toner images of magenta, cyan, black, and metallic color are sequentially primarily transferred and layered thereonto.

On a side opposite to the supporting roller 113 with the intermediate transfer belt 133 interposed therebetween, a belt cleaner 116 that cleans an outer peripheral surface of the intermediate transfer belt 133 is provided to be pressed against the supporting roller 113. In addition, on an upstream side of the belt cleaner 116 in the rotating direction of the intermediate transfer belt 133, a voltage applying unit 160 as the arranging unit that applies an electric field between the voltage applying unit 160 and the intermediate transfer belt 133 by generating a potential difference between the voltage applying unit 160 and the supporting roller 113 is provided.

Since the strength of the intermediate transfer belt 133 is high and may satisfy durability, it is preferable that the intermediate transfer belt 133 contain a polyimide resin or a polyamideimide resin. In addition, the surface resistivity of the intermediate transfer belt 133 is preferably in a range of from $1\times10^{9}$ Ω/□ to $1\times10^{14}$ Ω/□. In order to control the surface resistivity, the intermediate transfer belt 133 may optionally include a conductive filler. Examples of the conductive filler include metal or alloys such as carbon black, graphite, aluminum, or copper alloys; metal oxides such as tin oxide, zinc oxide, potassium titanate, tin oxide-indium oxide composite oxide or tin oxide-antimony oxide composite oxide; and conductive polymers such as polyaniline. These conductive fillers may be used alone or in a combination of two or more kinds. Among these, carbon black is preferable as the conductive filler from the viewpoint of cost. In addition, optionally, processing auxiliary agents such as a dispersant or a lubricant may be added.

In addition, around the photoreceptor 111Y, a cleaning unit 115Y that cleans toner, which remains on or is retransferred onto the surface of the photoreceptor 111Y, is arranged on a downstream side of the primary transfer roller 117Y in the rotating direction (arrow A direction) of the photoreceptor 111Y. A cleaning blade of the cleaning unit 115Y is attached to be brought into press contact with the surface of the photoreceptor 111Y in a counter direction.

A secondary transfer roller (secondary transfer unit) 134 is pressed with the bias roller 114 through the intermediate transfer belt 133, the bias roller 114 stretching the intermediate transfer belt 133. The toner images which are primarily transferred and layered onto the surface of the intermediate transfer belt 133 are electrostatically transferred onto a surface of a recording sheet (recording medium) P, which is supplied from a sheet cassette (not illustrated), in a nip portion between the bias roller 114 and the secondary transfer roller 134. At this time, among the toner images which are transferred and layered onto the intermediate transfer belt 133, the metallic toner image is located on the top surface (outermost layer). Therefore, among the toner images which are transferred onto the surface of the recording sheet P, the metallic toner image is located on the bottom surface (lowermost layer).

In addition, a fixing unit 135 that fixes the toner images, which are multiply transferred onto the recording sheet P, to the surface of the recording sheet P with heat and pressure to form a permanent image is arranged on a downstream side of the secondary transfer roller 134.

Examples of the fixing unit 135 include a belt-shape fixing belt in which a low surface energy material represented by a fluororesin component or a silicone resin is used for a surface thereof; and a cylindrical fixing roller in which a low surface energy material represented by a fluororesin component or a silicone resin is used for a surface thereof.

Next, the operations of the respective image forming units 150Y, 150M, 150C, 150K, and 150B that form the respective color images of yellow, magenta, cyan, black, and metallic color will be described. Since the operations of the respective image forming units 150Y, 150M, 150C, 150K, and 150B are the same, the operation of the yellow image forming unit 150Y will be described as a representative example.

In the yellow image forming unit 150Y, the photoreceptor 111Y rotates in the arrow A direction at a predetermined process speed. The surface of the photoreceptor 111Y is negatively charged to a predetermined potential by the charging roller 118Y. Next, the surface of the photoreceptor 111Y is exposed to light by the exposure unit 119Y such that an electrostatic charge image is formed based on image information. Next, the negatively charged toner is reversely developed by the developing unit 120Y such that the electrostatic charge image formed on the surface of the photoreceptor 111Y is visualized and formed as a toner image on the surface of the photoreceptor 111Y. Next, the toner image formed on the surface of the photoreceptor 111Y is primarily transferred onto the surface of the intermediate transfer belt 133 by the primary transfer roller 117Y. After the primary transfer, a transfer residual component such as toner remaining on the surface of the photoreceptor 111Y is scraped and cleaned by the cleaning blade of the cleaning unit 115Y. As a result, the photoreceptor 111Y is ready for the next image forming process.

The above-described operation is performed in the respective image forming units 150Y, 150M, 150C, 150K, and 150B. The toner images which are visualized on the surfaces of the respective photoreceptors 111Y, 111M, 111C, 111K, and 111B are sequentially multiply transferred onto the surface of the intermediate transfer belt 133. In a color mode, the respective color toner images of yellow, magenta, cyan, black, and metallic color are multiply transferred in this order. However, in a two-color mode or a three-color mode, only necessary color toner images are singly or multiply transferred in the above-described order. Next, the toner images which are singly or multiply transferred onto the surface of the intermediate transfer belt 133 are secondarily transferred onto the surface of the recording sheet P, which is supplied from the sheet cassette (not illustrated), by the secondary transfer roller 134. Next, the toner images are fixed with heat and pressure by the fixing unit 135. Toner remaining on the surface of the intermediate transfer belt 133 after the secondary transfer is caused to rise from the surface of the intermediate transfer belt 133 by the voltage applying unit 160 as the arranging unit that applies an electric field between the voltage applying unit 160 and the intermediate transfer belt 133. Then, the remaining toner is cleaned by the belt, cleaner 116 including the cleaning blade for the intermediate transfer belt 133.

The yellow image forming unit 150Y is configured as a process cartridge which is detachable from the image forming apparatus main body and in which the developing unit 120Y that includes a developer holding member for holding a yellow color electrostatic charge image developer is integrated with the photoreceptor 111Y, the charging roller 118Y, and the cleaning unit 115Y. In addition, similarly to case of the image forming unit 150Y, the image forming units 150B, 150K, 150C, and 150M are also configured as process cartridges.

In addition, toner cartridges 140Y, 140M, 140C, 140K, and 140B accommodate the respective color toners, are detachable from the image forming apparatus, and are connected to the developing units corresponding to the respective colors through toner supply tubes (not illustrated). When the amount of the toner accommodated in each toner cartridge is small, this toner cartridge is replaced with another one.

Specific examples of the charging unit, the electrostatic charge image forming unit, the cleaning unit, the transfer unit, the arranging unit, the electrostatic charge image developer, and the like according to the second exemplary embodiment are the same as those of the first exemplary embodiment.

The image forming apparatus according to the second exemplary embodiment includes the arranging unit that causes transfer residual toner, which remains on the surface of the intermediate transfer member, to rise from the surface of the intermediate transfer member. However, the image forming apparatus according to the second exemplary embodiment may further include another arranging unit that causes transfer residual toner, which remains on the surface of the image holding member, to rise from the surface of the image holding member.

EXAMPLES

Hereinafter, the exemplary embodiments will be described in more detail using Examples and Comparative Example. However, the exemplary embodiments are not limited to the following examples. Unless specified otherwise, "part(s)" and "%" represent "part(s) by weight" and "% by weight".

Synthesis of Binder Resin

Dimethyl adipate: 74 parts
Dimethyl terephthalate: 192 parts
Ethylene oxide adduct of bisphenol A: 216 parts
Ethylene glycol: 38 parts
Tetrabutoxy titanate (catalyst): 0.037 part The above-described components are put into a heated and dried two-necked flask, are held in an inert atmosphere by introducing nitrogen gas into the container, and are heated under stirring, followed by a polycondensation reaction at 160° C. for 7 hours. Next, the mixture is heated to 220° C. while slowly reducing the pressure to 10 Torr and held for 4 hours. After temporarily returning the pressure to normal pressure, 9 parts of trimellitic anhydride is added to the mixture, the pressure is gradually reduced to 10 Torr again, and the mixture is held at 220° C. for 1 hour. As a result, a binder resin is synthesized.

The glass transition temperature (Tg) of the binder resin is measured according to ASTMD3418-8 using a differential scanning calorimeter (DSC-50, manufactured by Shimadzu Corporation) in a temperature range from room temperature (25° C.) to 150° C. at a temperature increase rate of 10° C./min. The glass transition temperature is a temperature at an intersection between a base line and an extended line of a rising line in an endothermic portion. The glass transition temperature of the binder resin is 63.5° C.

Preparation of Resin Particle Dispersion

Binder resin: 160 parts
Ethyl acetate: 233 parts
Aqueous sodium hydroxide solution (0.3 N): 0.1 part The above-described components are put into a 1000 ml separable flask, are heated to 70° C., and are stirred with THREE-ONE MOTOR (manufactured by Shinto Scientific Co., Ltd.). As a result, a resin mixed solution is prepared. This resin mixed solution is further stirred at 90 rpm, 373 parts of ion exchange water is gradually added thereto, followed by phase-transfer emulsification and solvent removal. As a result, a resin particle dispersion (solid concentration: 30%) is obtained. The volume average particle size of the resin particle dispersion is 162 nm.

Preparation of Release Agent Dispersion

Carnauba wax (RC-160, manufactured by Toa Kasei Co., Ltd.): 50 parts
Anionic surfactant (NEOGEN RK, manufactured by Dai-Ichi Kogyo Seiyaku Co., Ltd.): 1.0 part
Ion exchange water: 200 parts A mixture of the above-described components is heated to 95° C., is dispersed with a homogenizer (ULTRA TURRAX T50, manufactured IKA Corporation), followed by dispersing with a Manton-Gaulin high-pressure homogenizer (manufactured by Gaulin) for 360 minutes. As a result, a release agent dispersion (solid concentration: 20%) in which release agent particles having a volume average particle size of 0.23 μm is dispersed is prepared.

Preparation of Brilliant Pigment Particle Dispersion

Aluminum pigment (2173EA, manufactured by Showa Aluminum Powder K.K.): 100 parts
Anionic surfactant (NEOGEN R, manufactured by Dai-Ichi Kogyo Seiyaku Co., Ltd.): 1.5 parts
Ion exchange water: 900 parts After a solvent is removed from a paste of the aluminum pigment, the above-described components are mixed, are dissolved, and are dispersed with an emulsifying disperser CAVITRON (CR1010, manufactured by Pacific Machinery & Engineering Co., Ltd.) for about 1 hour. As a result, a brilliant pigment particle dispersion (solid concentration: 10%) in which brilliant pigment particles (aluminum pigment) are dispersed is prepared.

The average major axis length of the aluminum pigment (metal pigment) is 8 μm and the average thickness thereof is 0.1 μm.

Example 1

Preparation of Toner

Resin particle dispersion: 380 parts
Release agent dispersion: 72 parts
Brilliant pigment particle dispersion: 140 parts The brilliant pigment particle dispersion, the resin particle dispersion, and the release agent dispersion are put into a 2 L cylindrical stainless steel container and are dispersed and mixed with a homogenizer (ULTRA TURRAX T50, manufactured IKA Corporation) for 10 minutes while applying a shearing force at 4000 rpm thereto. Next, 1.75 parts of 10% aqueous nitric acid solution of polyaluminum chloride as a coagulant is gradually added dropwise to the mixed dispersion, and the mixed dispersion is dispersed and mixed with a homogenizer at a rotating speed 5000 rpm for 15 minutes. As a result, a raw material dispersion is obtained.

Next, the raw material dispersion is poured to a polymerization kettle including a stirring device with two-paddle stirring blades and a thermometer and heating is started with a mantle heater at a stirring rotating speed or 810 rpm. Aggregated particles are grown at 54° C. In addition, at this time, the pH of the raw material dispersion is controlled to a range of from. 2.2 to 3.5 using 0.3 N nitric acid and 1 N aqueous sodium hydroxide solution. The raw material dispersion is held in the above-described pH range for about 2 hours, and aggregated particles are formed.

Next, the resin particle dispersion is additionally added such that the resin particles of the binder resin are attached on surfaces of the aggregated particles. Further, the temperature is raised to 56° C., and the aggregated particles are adjusted while confirming the size and the form of the particles with an optical microscope and MULTISIZER II, Next, in order to cause the aggregated particles to coalesce, the pH is increased to 8.0 and the temperature is raised to 67.5° C. After confirming that the aggregated particles coalesce with an optical microscope, the pH is decreased to 6.0 while maintaining the temperature at 67.5° C., After 1 hour, the dispersion is finished being heated and is cooled at a temperature decrease rate of 0.1° C./min. Next, the dispersion is sieved through a 20 μm mesh and repeatedly washed, with water, followed by drying with a vacuum drying machine. As a result, toner particles are obtained.

Further, the toner particles are heated with a warm air drying machine at 45° C. for 1 hour.

1.5 part of hydrophobic silica (RY50, manufactured by Nippon Aerosil Co., Ltd.) and 1.0 part of hydrophobic titanium oxide (T805, manufactured by Nippon Aerosil Co., Ltd.) with respect to 100 parts of the heated toner particles are mixed with a sand mill at 10000 rpm for 30 seconds. Next, the mixture is sieved through a vibration sieve having a mesh of 45 μm. As a result, a toner is prepared.

The toner has a volume average particle size of 12.2 μm, an average major axis length of 15 μm, an average thickness of 1.5 μm, and an average circularity of 0.6.

Preparation of Carrier

- Ferrite particles (volume average particle size: 35 μm) : 100 parts
- Toluene: 14 parts
- Perfluorooctylethylacrylate-methylmethacrylate copolymer: 1.6 parts
- Carbon black (trade name: VXC-72, manufactured by Cabot Corporation): 0.12 part
- Crosslinked melamine resin particles (average particle size: 0.3 μm, toluene insoluble): 0.3 part First, carbon black diluted with toluene is added to the perfluorooctylethylacrylate-methylmethacrylate copolymer, followed by dispersing with a sand mill. Next, the above-described components other than ferrite particles are dispersed in the above-described dispersion with a stirrer for 10 minutes. As a result, a coating layer-forming solution is prepared. Next, this coating layer-forming solution and the ferrite particles are put into a vacuum degassing kneader and are stirred at a temperature of 60° C. for 30 minutes. Then, toluene is removed by distillation under reduced pressure. As a result, a resin coating layer is formed, and a carrier is obtained.

Preparation of Developer 36 parts of the toner and 414 parts of the carrier are put into a 2 L V-blender, are stirred for 20 minutes, and are sieved through a 212 μm mesh. As a result, a developer is prepared.

Evaluation Test

In a modified machine of 700 DCP (manufactured by Fuji Xerox Co., Ltd.), a first charger as the arranging unit is provided at an upstream side of a portion where a cleaning blade for cleaning the image holding member is provided in the rotating direction of the image holding member, and a second charger is provided at an upstream side of a portion where a cleaning blade for cleaning the intermediate transfer member is provided in the rotating direction of the intermediate transfer member.

Using the toner prepared as above, images having an image density of 50% are output on 100, 000 sheets of A4-sized paper formed by operating only the first charger in an environment of 22° C. and 55% RH, and the effects are examined. The toner is arranged, by applying an electric field of 5000 V/m. As a result, small streaks are generated in about 75000 images clue to toner passing through.

Example 2

The same evaluation test as that of Example 1 is performed, except that, both the first charger and the second charge are operated. The toner is arranged by applying an electric field of 5000 V/m. As a result, all the 100000 images have no image defects and are superior.

Comparative Example 1

The same evaluation test as that of Example 1 is performed, except that 700 DCP (manufactured by Fuji Xerox Co., Ltd.) including no arranging unit is used. As a result, streaks caused by toner passing through are generated in a 20000-th formed toner image, and then toner streaks are increased.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charging unit that charges a surface of the image holding member;

an electrostatic charge image forming unit that forms an electrostatic charge image on a charged surface of the image holding member;

a developing unit that accommodates an electrostatic charge image developer containing flake shape toner particles and develops the electrostatic charge image, which is formed on the surface of the image holding member, using the electrostatic charge image developer to form a toner image, wherein the flake shape toner particles contain tabular shape pigments, the flake shape toner particles having an average major axis length of from 7 μm to 20 μm, an average thickness of from 1 μm to 3 μm and an average circularity of from 0.5 to 0.9, and the tabular shape pigments having an average major axis length of from 5 μm to 12 μm an average thickness of from 0.01 μm to 0.5 μm;

a transfer unit that transfers the toner image, which is formed on the surface of the image holding member, onto a surface of a recording medium;

an arranging unit that causes transfer residual toner, which remains on the surface of the image holding member, to rise from the surface of the image holding member, wherein the arranging unit lifts up only one side of the flake shape toner particles of the transfer residual toner;

a cleaning unit that includes a cleaning blade for cleaning the transfer residual toner remaining on the surface of the image holding member; and a fixing unit that fixes the toner image which is transferred onto the surface of the recording medium.

2. The image forming apparatus according to claim 1, wherein the arranging unit applies an electric field between the arranging unit and the image holding member.

3. The image forming apparatus according to claim 1, wherein the arranging unit is a voltage applying unit.

4. The image forming apparatus according to claim 1, wherein a hardness of the cleaning blade is from 50° to 100°.

5. The image forming apparatus according to claim 1, wherein the cleaning blade contains polyurethane.

6. The image forming apparatus according to claim 3, wherein a voltage applied to the arranging unit is in a range of from ±200 V to ±700 V.

7. The image forming apparatus according to claim 3, wherein a voltage applied to the arranging unit is in a range of from ±200 V to ±500 V.

8. An image forming apparatus comprising:

an image holding member;

a charging unit that charges a surface of the image holding member;

an electrostatic charge image forming unit that forms an electrostatic charge image on a charged surface of the image holding member;

a developing unit that accommodates an electrostatic charge image developer containing flake shape toner particles and develops the electrostatic charge image, which is formed on the surface of the image holding member, using the electrostatic charge image developer to form a toner image, wherein the flake shape toner particles contain tabular shape pigments, the flake shape toner articles a average major axis length of from 7 μm to 20 μm, an average thickness of from 1 μm to 3 μm and an average circularity of from 0.5 to 0.9, and the tabular shape pigments having an average major axis length of from 5 μm to 12 μm an average thickness of from 0.01 μm to 0.5 μm;

an intermediate transfer member onto which the toner image, which is formed on the surface of the image holding member, is primarily transferred;

a primary transfer unit that primarily transfers the toner image, which is formed on the surface of the image holding member, onto a surface of the intermediate transfer member;

a secondary transfer unit that secondarily transfers the toner image, which is primarily transferred onto the surface of the intermediate transfer member, onto a surface of a recording medium;

an arranging unit that causes transfer residual toner, which remains on the surface of the intermediate transfer member, to rise from the surface of the intermediate transfer member, wherein the arranging unit lifts up only one side of the flake shape toner articles of the transfer residual toner;

a cleaning unit that includes a cleaning blade for cleaning the transfer residual toner remaining on the surface of the intermediate transfer member; and a fixing unit that fixes the toner image which is transferred onto the surface of the recording medium.

9. The image forming apparatus according to claim 8, wherein the arranging unit applies an electric field between the arranging unit and the intermediate transfer member.

10. The image forming apparatus according to claim 8, wherein the arranging unit is a voltage applying unit.

11. The image forming apparatus according to claim 8, wherein a hardness of the cleaning blade is from 50° to 100°.

12. The image forming apparatus according to claim 8, wherein the cleaning blade contains polyurethane.

13. The image forming apparatus according to claim 9, wherein a voltage applied to the arranging unit is in a range of from ±200 V to ±700 V.

14. The image forming apparatus according to claim 9, wherein a voltage applied to the arranging unit is in a range of from ±200 V to ±500 V.

* * * * *